US007854257B2

(12) United States Patent
Broome et al.

(10) Patent No.: US 7,854,257 B2
(45) Date of Patent: Dec. 21, 2010

(54) MECHANICALLY COUPLED SCREEN AND METHOD

(75) Inventors: John T. Broome, The Woodlands, TX (US); Don N. Simoneaux, Washington, LA (US); Matthew P. Falgout, Kaplan, LA (US)

(73) Assignee: Baker Hughes Incorporated, Houston, TX (US)

( * ) Notice: Subject to any disclaimer, the term of this patent is extended or adjusted under 35 U.S.C. 154(b) by 57 days.

(21) Appl. No.: 11/706,522

(22) Filed: Feb. 15, 2007

(65) Prior Publication Data

US 2008/0196879 A1 Aug. 21, 2008

(51) Int. Cl.
*E21B 43/08* (2006.01)

(52) U.S. Cl. ..... 166/56; 166/242.1

(58) Field of Classification Search ..... 166/56, 166/227, 229, 195, 196; 285/353, 384, 385, 285/343, 246
See application file for complete search history.

(56) References Cited

U.S. PATENT DOCUMENTS

| | | | | |
|---|---|---|---|---|
| 2,070,291 | A * | 2/1937 | McHugh | 285/55 |
| 5,318,119 | A * | 6/1994 | Lowry et al. | 166/228 |
| 5,842,522 | A * | 12/1998 | Echols et al. | 166/378 |
| 5,931,232 | A * | 8/1999 | Echols et al. | 166/378 |
| 5,992,518 | A | 11/1999 | Whitlock | |
| 6,328,109 | B1 * | 12/2001 | Pringle et al. | 166/373 |
| 6,666,275 | B2 * | 12/2003 | Neal et al. | 166/386 |
| 6,708,946 | B1 * | 3/2004 | Edwards et al. | 251/58 |
| 6,732,803 | B2 * | 5/2004 | Garcia et al. | 166/373 |
| 6,776,241 | B2 * | 8/2004 | Castano-Mears et al. | 166/381 |
| 6,808,020 | B2 * | 10/2004 | Garcia et al. | 166/373 |
| 6,834,722 | B2 * | 12/2004 | Vacik et al. | 166/321 |
| 6,896,049 | B2 * | 5/2005 | Moyes | 166/82.1 |
| 7,152,678 | B2 * | 12/2006 | Turner et al. | 166/278 |
| 2003/0056959 | A1 * | 3/2003 | Castano-Mears et al. | 166/384 |
| 2004/0020832 | A1 * | 2/2004 | Richards et al. | 210/106 |
| 2004/0231854 | A1 | 11/2004 | Slack | |
| 2005/0000684 | A1 * | 1/2005 | Slack et al. | 166/77.1 |
| 2005/0218605 | A1 | 10/2005 | Walworth et al. | |
| 2006/0175770 | A1 * | 8/2006 | Linzell | 279/71 |
| 2007/0052236 | A1 * | 3/2007 | Wada | 285/384 |
| 2008/0047716 | A1 * | 2/2008 | McKee et al. | 166/384 |

FOREIGN PATENT DOCUMENTS

EP 1167686 A 1/2002

OTHER PUBLICATIONS

Restarick, Henry; "Horizontal Completion Options In Reservoirs With Sand Problems"; SPE29831; SPE Middle East Oil Show, Bahrain; Mar. 11-14, 1995; pp. 545-560.

PCT Search Report And Written Opinion PCT/US2008/050019; Mailed Jul. 24, 2008; Search Report Having 7 Pages And Written Opinion Having 6 Pages.

* cited by examiner

*Primary Examiner*—David J Bagnell
*Assistant Examiner*—James G Sayre
(74) *Attorney, Agent, or Firm*—Cantor Colburn LLP

(57) ABSTRACT

A particulate exculder tool includes a basepipe having one or more retention features; a screen jacket disposed radially outwardly of the basepipe; one or more end housings at the screen jacket; and a deformable element disposed between a portion of the one or more end housings and one or of the one or more retention features and method.

16 Claims, 3 Drawing Sheets

MECHANICALLY COUPLED SCREEN AND METHOD

BACKGROUND

In many downhole fluid production wells, particulate matter production is to be avoided. In view hereof, "sand screens" are often used to exclude particulate matter from fluidic components entering the production apparatus. Sand screens sometimes include a holed base pipe, a filtration medium and a shroud. The filtration medium and shroud are often preassembled as a jacket before installation thereof on the holed base pipe. In order to enhance life of service of the production well and particularly as the wells get deeper, it is common to use higher alloy steels in the base pipe. While this material does indeed present excellent resistance to abrasive degradation, it also promotes an ancillary problem. The problem is related to the method commonly used for attachment of the jacket to the base pipe. Generally, the favored attachment means is by welding. Welding high alloy materials, while being effective from an affixation standpoint, also may cause the high alloy material to corrode more readily. Since wellbore environments are naturally highly corrosive, the drawback associated with welding as noted is particularly detractive.

In view of the foregoing, the art would welcome screen jacket coupling methods and apparatus that avoid welding thereby avoiding the foregoing effects and additionally avoiding, generally necessary, heat treating operations after welding to stress relieve and temper the final product.

SUMMARY

A particulate exculder tool includes a basepipe having one or more retention features; a screen jacket disposed radially outwardly of the basepipe; one or more end housings at the screen jacket; and a deformable element disposed between a portion of the one or more end housings and one or of the one or more retention features and method.

BRIEF DESCRIPTION OF THE DRAWINGS

Referring now to the drawings wherein like elements are numbered alike in the several Figures.

DETAILED DESCRIPTION

Figure 1:
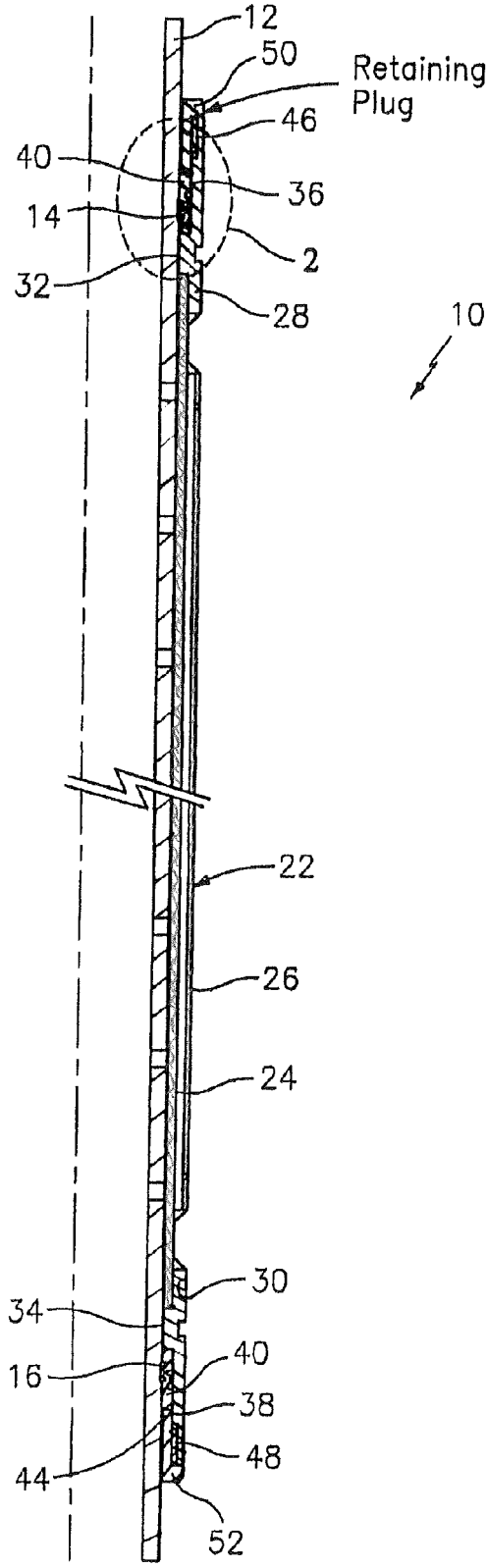
FIG. 1 is an illustration of a well tool having a screen coupled thereto according to the disclosure herein.
Figure 2:
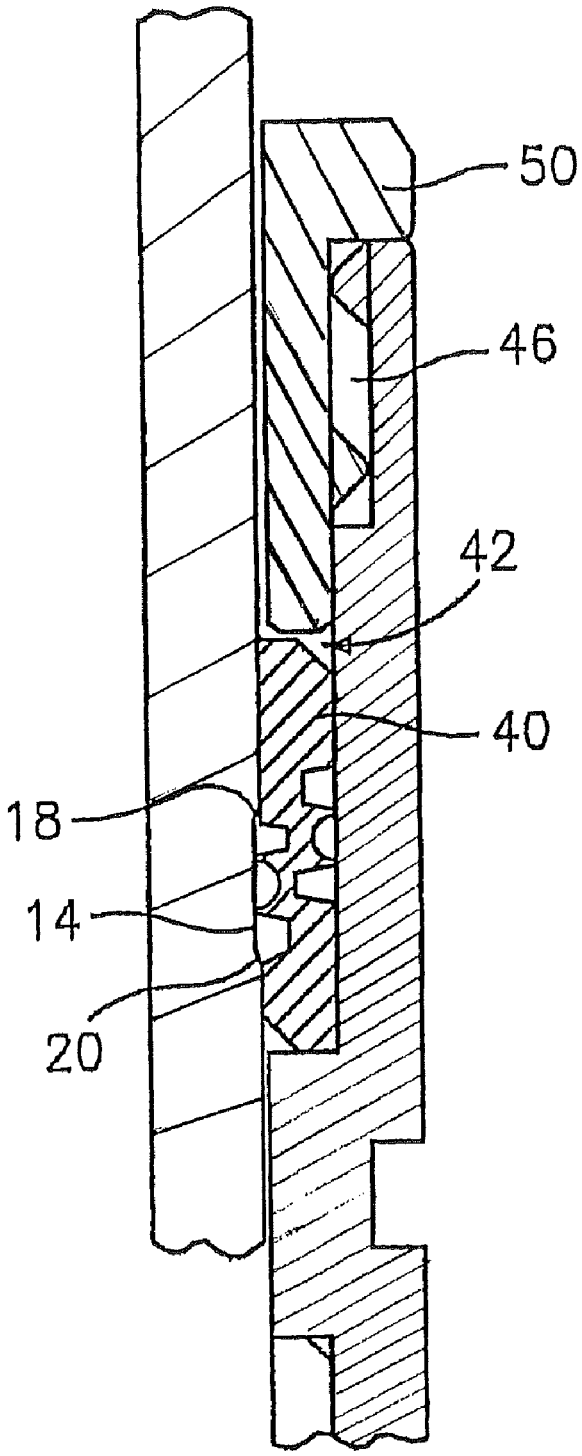
FIG. 2 is an enlarged view of a circumscribed portion of FIG. 1 taken along circumscription line 2-2.

Referring to FIGS. 1 and 2 simultaneously, a particulate matter exclusion tool or sand screen 10 is illustrated.

The tool 10 includes a base pipe 12 having at least one undercut, and illustrated with retention features such as undercuts 14 and 16 (undercut 14 illustrated in enlarged form in FIG. 2). Each undercut 14 and 16 preferably provides a shoulder uphole and downhole of the undercut. Shoulders 18 and 20 are illustrated in FIG. 2 for undercut 14 and it shall be understood that similar shoulders are provided at undercut 16, though not visible without enlargement as in FIG. 2. Each undercut is in one embodiment at least about 0.060 deep so that the shoulders bear that measurement. Reasoning for this will become apparent hereunder. It will be appreciated that this is the component of the screen likely to be composed of a high alloy metal and therefore sensitive to welding.

Disposed about the base pipe 12 is a screen jacket 22, (a sand exclusion device) which screen is configured to exclude particulate matter having dimensions greater than a predetermined set of dimensions. Such screen jacket is in one embodiment configured as noted above to have a filter medium 24 and a shroud 26. The jacket 22 is substantially the same as screen jackets on commercially available sand screens from Baker Oil Tools, Lafayette, La. and therefore requires limited discussion here.

The screen jacket disclosed herein includes end housings 28 and 30 that are configured with a first inside dimension at numeral 32 and 34, respectively, and a second inside dimension at 36 and 38, again respectively. In each case, the first inside dimension is selected to closely clear an outside dimension of the base pipe 12 while the second inside dimension is selected to be spaced from the outside dimension of the base pipe 12 by an amount sufficient to accept a deformable element (which may in some configurations be both a mechanical attachment and a seal and in other configurations represent less than 360 degrees of contact with the base pipe such that the deformable element acts only as a mechanical attachment) 40 in clearance relationship therewith where the element 40 is in an unactuated condition and in an interference relationship when the element is in an actuated condition. For purposes of clarity of disclosure, the space defined by the second inside dimension of the end housings and the base pipe will be referred to herein as pockets 42 and 44. Pockets 42 and 44 are to be aligned axially with undercuts 14 and 16, respectively so that seals 40 disposed within pockets 42/44, when activated, contact each undercut. Further, each end housing 28 and 30 includes a box thread 46 and 48, respectively, which is to threadably receive a collar 50 and 52, respectively. Collars 50 and 52 thread into their respective end housings 28 and 30 to reduce the axial dimension of pockets 42 and 44. By reducing this axial dimension, with the element 40 installed therein, the element is caused to deform both radially inwardly and radially outwardly into contact with undercuts 14 and 16 and, respectively, the second inside dimension of each end housing 28 and 30. By so deforming the element, the screen jacket 22 is mechanically locked in place without the need for welding to the basepipe. Further the post heat treatment generally required after such a welding operation is avoided saving both cost and time.

In one embodiment, the element 40 is a metal element and may be a mini z seal commercially available from Zeroth Technology Limited.

Figure 3:
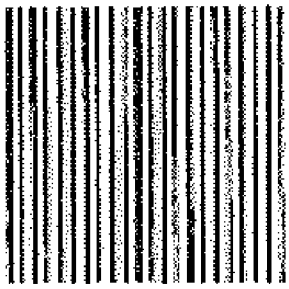
FIG. 3 is a view of a longitudinal groove or spline pattern.
Figure 4:
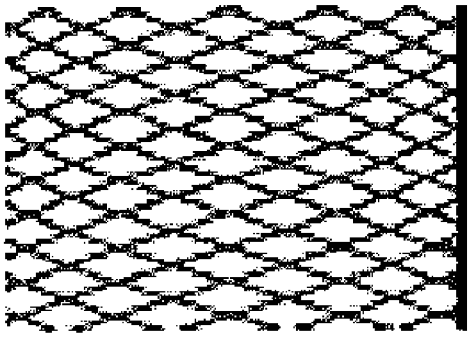
FIG. 4 is a view of a helical groove pattern.

As is visible in FIG. 2, element 40 is in the activated position and extends into the undercut 14. Depending upon the amount of axial compression of element 40 from collar 50, the element may move axially until contacting one of shoulders 18 or 20, or indeed may be frictionally affixed wherever it made contact with the undercut when activated. Further, in another embodiment, the retention features include the frictional coefficient of the basepipe at the undercuts or at the same location without undercuts. The frictional coefficient may be enhanced by surface preparation thereof such as by knurling (eg. to create grooves), roughening, splining, or other surface treatment as shown in FIGS. 3-4. Such treatments will improve not only axial retention of the screen jacket but rotational retention as well. In yet another embodiment, the surface treatment is sufficient to provide the needed retention against the elements 40 so that undercuts are not required. It is also to be understood that the undercuts could be substituted for by an upstruck member at the outside dimension of the base pipe against which the element 40 can bear with the same effect of anchoring the screen providing that a greater clearance at the end housings is provided so that the screen can be installed thereover.

While preferred embodiments have been shown and described, modifications and substitutions may be made thereto without departing from the spirit and scope of the invention. Accordingly, it is to be understood that the present invention has been described by way of illustrations and not limitation.

The invention claimed is:

1. A particulate excluder tool comprising:

a basepipe having one or more retention features including one or more undercuts each having at least one shoulder;

a screen jacket disposed radially outwardly of the basepipe;

one or more end housings at the screen jacket; and a deformable element disposed radially between a portion of the one or more end housings and one of the one or more retention features, the at least one shoulder inhibiting deformable element movement axially of the tool, the deformable element when deformed, mechanically locking the screen jacket in place.

2. The tool as claimed in claim 1 wherein the deformable element is a metal element.

3. The tool as claimed in claim 1 wherein the element is in contact with the at least one retention feature for 360°.

4. The tool as claimed in claim 1 wherein the element forms an annular seal between the base pipe and one of the one or more end housings.

5. A particulate excluder tool comprising:

a basepipe having one or more retention features including surface preparation to enhance friction thereof;

a screen jacket disposed radially outwardly of the basepipe;

one or more end housings at the screen jacket;

a deformable element disposed radially between a portion of the one or more end housings and one of the one or more retention features the deformable element when deformed, mechanically locking the screen jacket in place.

6. The tool as claimed in claim 5 wherein the surface preparation is longitudinal grooves.

7. The tool as claimed in claim 6 wherein the grooves are knurled.

8. The tool as claimed in claim 6 wherein the grooves are splines.

9. The tool as claimed in claim 5 wherein the surface preparation is helical grooves.

10. The tool as claimed in claim 5 wherein the surface preparation is roughness.

11. A particulate excluder tool comprising:

a basepipe having one or more retention features;

a screen jacket disposed radially outwardly of the basepipe;

one or more end housings at the screen jacket;

a deformable element disposed radially between a portion of the one or more end housings and one of the one or more retention features the deformable element being deformable by axial compression, the axial compression being created by a threaded collar, the axial compression thereby maintained indefinitely and when deformed, the deformable member mechanically locking the screen jacket in place.

12. A method for attaching a screen jacket to a base pipe comprising:

disposing the screen jacket radially outwardly of the base pipe at a retention feature, the screen jacket having at least one end housing;

deforming a deformable element disposed radially between the at least one end housing and the base pipe and thereby mechanically locking the screen jacket in place;

contacting the deformable element to both of the at least one screen jacket end housing and the base pipe.

13. The method as claimed in claim 12 wherein the deforming is by compressing the element.

14. The method as claimed in claim 13 wherein the compressing is axial.

15. The method as claimed in claim 14 wherein the method further comprises configuring the base pipe with at least one retention feature.

16. The method as claimed in claim 15 wherein the contacting occurs between the screen jacket and the undercut.

* * * * *